US006163672A

United States Patent [19]

Parker et al.

[11] Patent Number: 6,163,672

[45] Date of Patent: Dec. 19, 2000

[54] TANDEM TRI-LEVEL XEROGRAPHIC APPARATUS AND METHOD FOR PRODUCING HIGHLY REGISTERED PICTORIAL COLOR IMAGES

[75] Inventors: Delmer G. Parker, Rochester; Michael M. Shahin, Pittsford, both of N.Y.

[73] Assignee: Xerox Corporation, Stamford, Conn.

[21] Appl. No.: 09/343,500

[22] Filed: Jun. 30, 1999

[51] Int. Cl.[7] ..... G03G 15/01

[52] U.S. Cl. ..... 399/223; 399/299

[58] Field of Search ..... 399/178, 179, 399/223, 231, 298, 299, 302, 308, 301; 347/115, 232, 116

[56] References Cited

U.S. PATENT DOCUMENTS

| | | | |
|---|---|---|---|
| 5,221,954 | 6/1993 | Harris . | |
| 5,223,906 | 6/1993 | Harris . | |
| 5,337,136 | 8/1994 | Knapp et al. . | |
| 5,367,327 | 11/1994 | Harris | 347/115 |
| 5,534,990 | 7/1996 | Harris | 399/223 |
| 5,613,176 | 3/1997 | Grace | 399/223 |
| 5,751,437 | 5/1998 | Parker et al. | 347/232 |
| 5,837,408 | 11/1998 | Parker et al. | 399/179 X |

*Primary Examiner*—Sandra Brase

*Attorney, Agent, or Firm*—Tallam I. Nguti

[57] ABSTRACT

Apparatus and method for creating highly registered quality pictorial color images include a first tri-level xerographic module using first and second color marking materials for creating and developing a first tri-level image including custom CAD and custom DAD image areas having different voltage levels respectively to form a first composite color separation image; a transfer station for transferring the first composite color separation image onto an intermediate transfer member; a second tri-level xerographic module using third and fourth color marking materials for similarly creating and developing a second tri-level image including custom CAD and custom DAD image areas having different voltage levels respectively to form a second composite color image; a transfer station for transferring the second composite color separation image, in registration onto the intermediate transfer member; a third tri-level xerographic module using fifth and sixth color marking materials for similarly creating and developing a third tri-level image including custom CAD image areas and custom DAD image areas having different voltage levels respectively to form a third composite color image; wherein pairings of the first and second, third and fourth, and fifth and sixth, color marking materials are selected so that one such pairing is cyan (C) and magenta (M) so as to improve registration of the desired final pictorial image.

15 Claims, 1 Drawing Sheet

TANDEM TRI-LEVEL XEROGRAPHIC APPARATUS AND METHOD FOR PRODUCING HIGHLY REGISTERED PICTORIAL COLOR IMAGES

BACKGROUND OF THE INVENTION

This invention relates to full color, dot next to dot, xerographic printing systems or apparatus, and more particularly to a tandem tri-level xerographic apparatus and method for producing highly registered quality pictorial color images.

Xerocolography (a form of xerography for dry color printing) is a color printing architecture which combines multi-color xerographic development with multiwavelength laser diode light sources, with a one polygon, single optics ROS and with a polychromatic, multilayered photoreceptor to provide color printing in either a single pass or in two passes. Inherently perfect registration is achieved since the various color images are all written at the same imaging station with the same ROS. In all three latent images are written in this manner. Two of the three images are immediately developable because their voltage levels are offset from a background level while the voltage level of the third image is at the time of its formation equal to the background voltage level. Before the third image can be developed, the photoreceptor must be exposed to flood illumination of a predetermined wavelength.

Xerography is capable of producing either highlight color or process color images in a single pass as well as in multiple passes. In creating full process color images, using Image-On-Image (IOI) technology, toner particles are deposited on already developed toner images. With this type of imaging, it is desirable to use Non-Interactive Development (NID) in order to avoid scavenging of an already developed image.

Conventionally, full gamut color imaging in a single pass is possible using four or more voltage level images but these systems suffer from the need to form latent images by exposing through already developed images. As evidenced by the success of the commercially available highlight color machines which use tri-level imaging, the development fields which are half those of conventional xerography are practical. However, four or more voltage level images are difficult to develop because of the problems of dealing with large cleaning fields and small development fields.

In a conventional tandem architecture, four separate xerographic engines, each consisting of a ROS, a photoreceptor and a development system are used in series to develop and transfer the CMYK toners needed to produce process color images. If a special color is needed for a logo or to broaden the color gamut it must be added as a fifth xerographic engine with ROS, photoreceptor and development system. Known tandem engine imaging apparatuses require as many as four separate image registrations. As will be appreciated, the more image registrations required the more there is a possibility for image misregistration resulting in unwanted color overlapping and fringing.

A first embodiment and second embodiment of the tandem xerography architecture to be described are each capable of producing quality pictorial color images with only three xerographic imaging modules as opposed to the four xerographic modules required for conventional tandem xerography.

Following is a discussion of prior art, incorporated herein by reference, which may bear on the patentability of the present invention. In addition to possibly having some relevance to the question of patentability, these references, together with the detailed description to follow, are intended to provide a better understanding and appreciation of the present invention.

U.S. Pat. No. 5,221,954 entitled "Single Pass Full Color Printing System Using A Quad-Level Xerographic Unit" granted to Ellis D. Harris on Jun. 22, 1993 discloses a four color toner single pass color printing system consisting generally of a raster output scanner (ROS) optical system and a quad-level xerographic unit and a tri-level xerographic unit in tandem. The resulting color printing system would be able to produce pixels of black and white and all six primary colors. The color printing system uses a black toner and toners of the three subtractive primary colors or just toners of the three subtractive primary colors.

U.S. Pat. No. 5,223,906 entitled "Four Color Toner Single Pass Color Printing System Using Two Tri-Level Xerographic Units" granted to Ellis D. Harris on Jun. 29, 1993 discloses a four color toner single pass color printing system consisting generally of a raster output scanner (ROS) optical system and two tri-level xerographic units in tandem. Only two of the three subtractive primary colors of cyan, magenta and yellow are available for toner dot upon toner dot to combine to produce the additive primary colors. The resulting color printing system would be able to produce pixels of black and white and five of the six primary colors, with pixel next to pixel printing producing all but the strongest saturation of the sixth primary color, an additive primary color. The color printing system uses either four color toners or a black toner and three color toners.

U.S. Pat. No. 5,337,136 entitled "Tandem Tri-level Process Color Printer" granted to John F. Knapp et al on Aug. 9, 1994 discloses a tandem tri-level architecture. Three tri-level engines are arranged in a tandem configuration. Each engine uses one of the three primary colors plus one other color. Spot by spot, two color tri-level images can be created by each of the engines. The spot by spot images are transferred to an intermediate belt member, either in a spot on spot manner for forming full color images or in a spot next to spot manner to form highlight and/or logo color images. The images created by the tri-level engines can also be transferred to the intermediate in a manner such that both spot next to spot and spot on spot transfer is effected.

Previous or conventional tri-level Xerographic processes typically produce perfectly registered, two color or high light color images at within a range of about 50 to 90 prints per minute. As disclosed above, the intriguing possibility of making full color images in a single pass by overprinting or superimposing two tri-level images has occurred to others. Their ideas generally take the form of either a two cycle machine or two tri-level processes in series or tandem along one continuous belt photoconductor, with each tri-level process having a separate ROS. The throughput rate for the single pass version is the same as the tri-level process itself, while throughput rate for the two cycle arrangement is half or less.

Unfortunately, neither of these approaches is capable of producing a full color gamut because the two colors that make up the composite tri-level image can never be superimposed, i.e., they are mutually exclusive. For example, if a tri-level image is printed using colors A & B and then superimposed over a second tri-level image printed with colors C & D, it is possible to obtain the colors A+C, A+D, B+C, and B+D in addition to colors A, B, C and D. But, it is not possible to obtain A+B or C+D. In this case, if ABCD represented KYMC, it would not be possible to print blue (C+D) or overprint yellow on black (A+B).

Moreover, unless the wave length of the exposure unit used were such that the second tri-level latent image can be exposed through the preexisting first tri-level developed image, then the above process requires that the two composite tri-level images be developed and transferred separately. This of course is not true if the two tri-level images are developed and registered "side by side" using the color set KRGB instead of that KYMC. However, if this is to be accomplished using one transfer, the second tri-level image separation must be developed with a non-contact, cloud development system which does not respond to the gradients or to the large reverse (cleaning) field associated with the companion color latent image. Unfortunately however, there is no known development system that satisfies these requirements.

Current conventional approaches to full gamut color printing include the tandem engine approach, and the multiple superposition REaD (Recharge, Expose and Develop) approach. Both can be implemented in a cyclic mode with as few as one ROS. Although a multi-cycle color process uses fewer hardware components (one charge, ROS, and cleaning station), its throughput rate is ordinarily less than, or equal to, the process speed divided by the number of process cycles. Furthermore, in the cyclic mode, each development system, and the cleaning system, (and in the case of REaD, the transfer station), must be enabled and disabled every print cycle. In addition, at least 4 color separations must be registered.

The single pass REaD approach requires a single, long photoreceptor to accommodate four or more recharge, expose and development stations. The manufacturing yield on long, defect free, belt PCs is very low at present. Photoconductors of the length required for REaD also cause tracking/registration problems and are difficult to replace in the field.

One significant problem with approaches attempting to do tandem multicolor prints involves the need to register (on the intermediate transfer member) the cyan components of green and blue from one module, with the magenta component of red from another different module. Because these are the darker components of red, green and blue, and because the eye is more sensitive to color shifts caused by registrations errors in the placement of such darker components, such transfer and resulting registration errors are undesirable.

SUMMARY OF THE INVENTION

In accordance with one aspect of the present invention, there is provided a method for creating highly registered quality pictorial color images using three tri-level xerographic modules. The method includes the steps of uniformly charging a photoconductive member of a first tri-level xerographic module to a predetermined voltage level; creating tri-level latent electrostatic images including CAD image areas and custom DAD image areas, having different voltage levels respectively; developing the CAD image areas and the custom DAD image areas with a first color and a second color marking materials respectively to form a first composite color separation image of a desired final pictorial image.

The method then includes the steps of transferring the first composite color separation image onto an intermediate transfer member; similarly creating and developing, on a second tri-level xerographic module, a second tri-level image using a third color and a fourth color, marking materials respectively, to form a second composite color separation image; transferring the second composite color separation image, in registration with the first composite color separation image, onto the intermediate transfer member; similarly creating and developing, on a third tri-level xerographic module, a third tri-level image using a fifth color and a sixth color, marking materials respectively, to form a third composite color separation image, wherein the pair of first and second, third and fourth, and fifth and sixth, color marking materials are selected so that one such pair is cyan (C) and magenta (M) for improving registration of the desired final pictorial image; transferring the third composite color separation image in registration with the first and second composite color separation images, onto the intermediate transfer member to form a desired final pictorial image; and a substrate transfer station for transferring the desired final pictorial image onto a substrate for fusing.

In accordance with another aspect of the present invention, there is provided a tandem xerographic apparatus for creating highly registered quality pictorial color images. The tandem xerographic apparatus includes a first tri-level xerographic module comprising a charging device for uniformly charging a photoconductive member thereof to a predetermined voltage level; a controller and a ROS device for creating tri-level latent electrostatic images including CAD image areas and custom DAD image areas, having different voltage levels respectively; two development units for developing the CAD image areas and the custom DAD image areas with a first color and a second color, marking materials respectively to form a first composite color separation image of a desired final pictorial image; a transfer station for transferring the first composite color separation image onto an intermediate transfer member.

The tandem xerographic apparatus also includes a second tri-level xerographic module for similarly forming and developing a second composite color separation image using a third color and a fourth color, marking materials respectively; a transfer station for transferring the second composite color separation image, in registration with the first composite color separation image, onto the intermediate transfer member. The tandem xerographic apparatus then includes a third tri-level xerographic module for similarly forming and developing a third composite color image on a third tri-level xerographic module using a fifth color and a sixth color, marking material, wherein the pair of first and second, third and fourth, and fifth and sixth, color marking materials are selected so that one such pair is cyan (C) and magenta (M) for improving registration of the desired final pictorial image; a transfer station for transferring the third composite color separation image in registration with the first and second composite color separation images, onto the intermediate transfer member to form a desired final pictorial image. The tandem xerographic apparatus further includes a substrate transfer station for transferring the desired final pictorial image onto a substrate for fusing.

BRIEF DESCRIPTION OF THE DRAWINGS

In the detailed description of the invention presented below, reference is made to the drawing, in which.

DETAILED DESCRIPTION OF THE INVENTION

Figure 1:
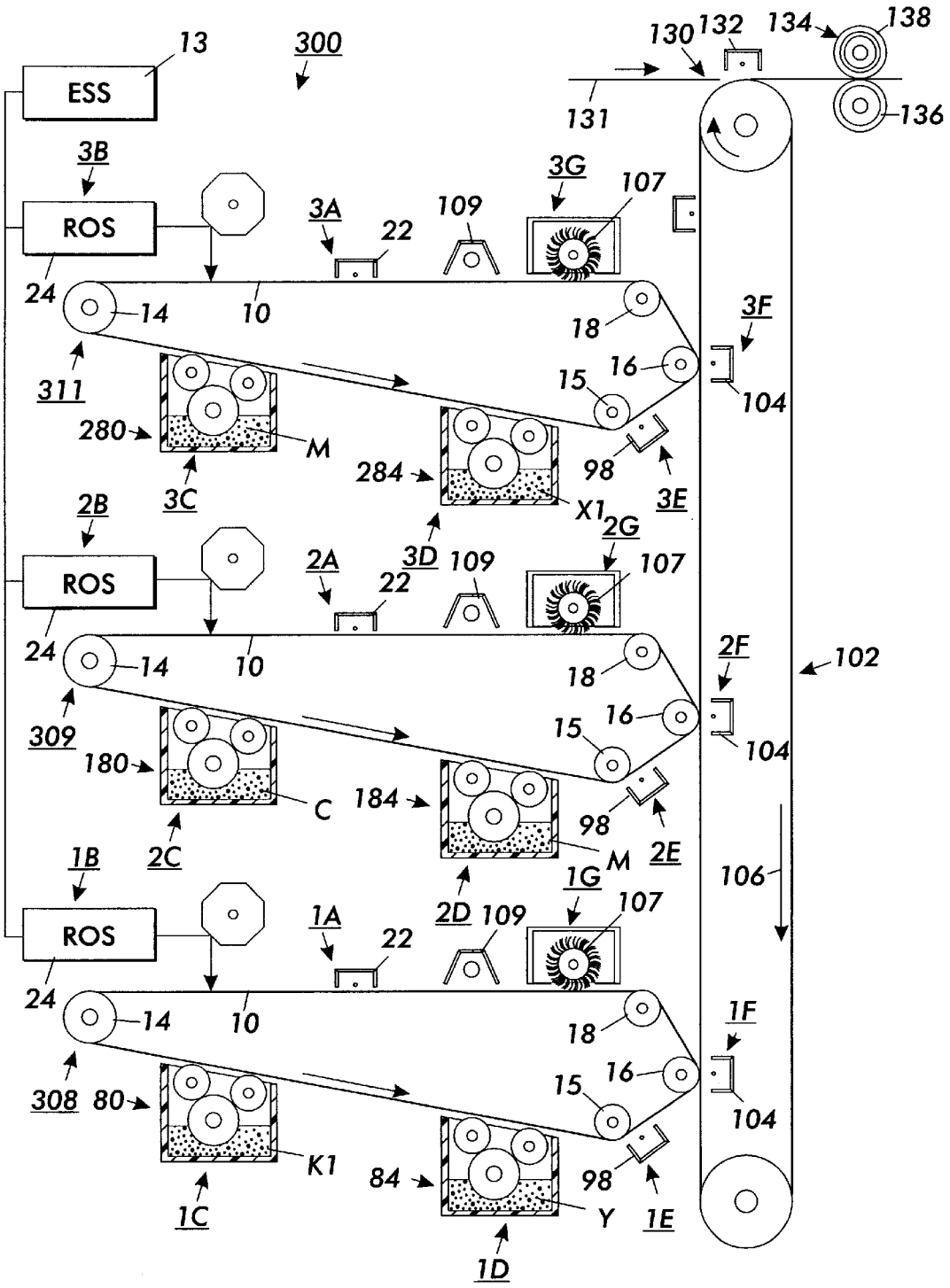
FIG. 1 is a schematic illustration of the tandem xerographic apparatus, in accordance with the present invention, for producing highly registered quality pictorial color images.

Referring now to FIG. 1, there is shown generally as 300, the tandem xerographic apparatus of the present invention for producing highly registered quality pictorial color images in accordance with the present invention. As shown, the tandem xerographic apparatus 300 comprises three tri-level xerographic imagers or modules 308, 309 and 311 that each include a member in the form of a photoconductive belt structure 10 having a photoconductive surface with an electrically conductive substrate.

A tri-level xerographic imager or module as such is a xerographic apparatus in which charge latent images including at least three different levels of charge (tri-level latent image) are formed on a charged photoconductive surface, and then appropriately developed in a single pass with at least two different colors of marking material. Each such tri-level latent image thus includes CAD (Charged Area Development) image areas having a first level of charge for example, DAD (Discharged Area Development) image areas having a second level of charge, and background areas having a third level of charge.

In accordance with the present invention, highly registered quality pictorial color prints can be obtained in a single pass by superimposing, on a receiving substrate or intermediate member 102, the outputs of three tri-level Xerographic modules 308, 309 and 311 having a particular selection of pairs of colors, and arranged in tandem. This concept uses proven tri-level development technology, has a non-reduced throughput rate, and employs photoreceptors that each are the same length as those used in ordinary products. As will be described below, such highly registered quality pictorial color prints can also be made with one less ROS than a number of ROS devices ordinarily needed with either conventional tandem or REaD architectures.

According to the present invention, a total of six colors are printed in groups of two on each module as shown. In the present invention (FIG. 1) each of the tri-level modules 308, 309 and 311, thus prints using a total of six different colors of marking materials. The six different colors are print in pairs of two, namely, first and second, third and fourth, and fifth and sixth, color marking materials, which are selected so that one such pair is cyan (C) and magenta (M) in order to yield a highly registered desired final pictorial image. The six different colors of marking materials include, Yellow, Magenta, Cyan, (YMC) used at least once, and at least one black (K1). One or two arbitrary optional colors (X1, X2) may be added if necessary to bring the number of colors to six. These optional colors, X1, X2 can include a second but different density black (K2), or any bright colors such as red (R), green (G) or blue (B), in order to increase the output color gamut, or it can be a special custom color for logos and the like.

A controller or electronic control subsystem (ESS) 13, preferably in the form of a programmable microprocessor, is provided for controlling the various functions and aspects of the present invention, including the ROS formation of CAD and DAD latent images on each module 308, 309 and 311. The microprocessor controller 13 thus is connected to the ROS of each module and to other components and subsystems of the apparatus 100, and provides electrical command signals for operating all of such components and subsystems.

As shown in the drawing, (FIG. 1), in the first tri-level module 308, the belt 10 is mounted for movement past a series of xerographic process stations including a charging station 1A, a single exposure station 1B, a first development station 1C using a first color marking material, a second development station 1D using a second color marking material, a pretransfer charging station 1E, and a transfer station 1F.

In like manner, in the second tri-level imager module 309, the belt 10 is mounted for movement past a series of xerographic process stations including a charging station, 2A a single exposure station 2B, a first development station 2C, using a third color marking material, a second development station 2D using fourth color marking material, a pretransfer charging station 2E, and a transfer station 2F.

Similarly in the third tri-level imager module 311, the belt 10 is mounted for movement past a series of xerographic process stations including a charging station 3A, a single exposure station 3B, a first development station 3C using a fifth color marking material, a second development station 3D using a sixth color marking material, a pretransfer charging station 3E, and a transfer station 3F. Importantly in accordance with the present invention as mentioned above, the pair of first and second, third and fourth, and fifth and sixth, color marking materials being used on the first, second and third xerographic modules, are selected so that at least one such pair is comprised of cyan (C) and magenta (M) marking materials.

Referring still to FIG. 1, in each of the tri-level modules 308, 309 and 311, the belt 10 moves in the direction of arrow 12 in order to advance successive portions thereof sequentially through the various processing stations which are disposed about the path thereof. As shown on the first module 308, but also true of the other modules 309 and 311, belt 10 is entrained about a plurality of rollers 14, 15, 16 and 18. The roller 16 may be used as a drive roller and the roller 14 may be used to provide suitable tensioning of the belt photoreceptor 10. Motor (not shown) rotates roller 16 to advance belt 10 in the direction of arrow 12. Roller 16 is coupled to motor (not shown) by suitable means such as a belt drive (not shown).

As can be seen by further reference to FIG. 1, and for each of the modules 308, 309 and 311, initially successive portions of belt 10 pass through charging station 1A, 2A, 3A. At charging station 1A, 2A, 3A, a corona discharge device such as a scorotron, corotron or dicorotron 22, charges the belt 10 to a selectively high uniform positive or negative potential level. Any suitable control, well known in the art, may be employed for controlling the corona discharge device 22.

Next, in each module, the uniformly charged portions of the photoreceptor surface of belt 10 are advanced through exposure station 1B, 2B, 3B. At exposure station 1 B, 2B, 3B, each uniformly charged portion of the photoreceptor surface of belt 10 is exposed to a laser based output scanning device 24 which causes the charge retentive surface to remain charged or to be discharged in accordance with the output from the controller 13 through such scanning device 24. The scanning device 24 is a multi-level, e.g. two-level (2 bit) Raster Output Scanner (ROS). The Electronic control SubSystem (ESS) 13, for example, may convert previously stored pictorial image data into appropriate control signals for use the ROS 24 in an imagewise fashion for exposing the belt 10. Such exposure results in the photoreceptor containing for example, latent electrostatic image areas having three different voltage levels (tri-level), as is well known in tri-level xerography. The three voltage levels correspond to background areas and two different image areas, namely CAD image areas and DAD image areas. For each module 308, 309 and 311, two development apparatuses (one at each development station), are thus provided for developing the two different image areas with different color toners, to be described below.

As illustrated further in the drawing, and with particular reference to the first tri-level imager module 308, its belt photoreceptor 10 moves past the first development station 1C including a development unit 80 containing a first color, preferably black, marking material K1 in accordance with the present invention. The CAD image areas of the tri-level latent image of the first module 308 (which includes areas or regions of the desired final pictorial color image) is developed by the development unit 80 into a first image separation using the black marking material K1. The development unit 80 can be a Non Interactive Development (NID) device or a magnetic brush development device since the CAD image areas is the first image being developed.

Next, the tri-level image (now including the black developed image) is moved past the second development station 1D including a second development unit 84 containing a second color, preferably, yellow marking material. The second development unit 84 develops the custom DAD image areas of tri-level latent image (of the first module 308) by depositing yellow marking material thereon to form a second separation image, and thus a first composite color separation image (K1, Y) on the belt 10. Importantly in accordance with one aspect of the present invention, the custom DAD image areas of the tri-level latent image (of the first module 308) as produced using the controller 13 and ROS 24, and now developed with yellow marking material, include regions of the desired final pictorial image that shall be in yellow, as well as in green or red.

Following such development, the first composite color separation image (K1, Y) on belt 10 is moved to the pretransfer charging station 1E. Because this composite color separation image developed on the belt 10 consists of both positive and negative marking material, a typically positive pretransfer corona discharge member 98 disposed at the pretransfer charging station is provided for conditioning the marking material or toner for effective transfer to a substrate at a transfer station using positive corona discharge.

The pretransfer corona discharge member is preferably an AC corona device biased with a DC voltage to operate in a field sensitive mode and to perform tri-level xerography pretransfer charging in a way that selectively adds more charge (or at least comparable charge) to the part of composite tri-level image that must have its polarity reversed compared to elsewhere. This charge discrimination can be enhanced by discharging the photoreceptor carrying the composite developed latent image with light (not shown and usually done through the back of the belt photoreceptor) before the pretransfer charging begins. Furthermore, flooding the photoreceptor with light coincident with the pretransfer charging minimizes the tendency to overcharge portions of the image which are already at the correct polarity.

The first composite color separation image (K1, Y) is subsequently transferred at the transfer station 1F using a transfer corona device 104. As shown, it is transferred onto an Intermediate Transfer Belt (ITB) 102 which is supported in intimate contact with the photoreceptor 10 for synchronous movement therewith. As shown, transfer station 1F includes the corona generating device 104 which sprays ions of a suitable polarity onto the backside of belt 102. This attracts the first composite color separation image (K1, Y) from the photoreceptor belt 10 onto the ITB 102. After such transfer, the ITB 102 continues to move, in the direction of arrow 106 towards the second tri-level module 309 of the present invention.

After the first composite color separation image (K1, Y) has been transferred to the ITB 102 from a portion of the photoconductive surface of belt 10, residual toner or marking particles left on such portion of the surface of the belt 10 are removed at cleaning station 1G including, for example, a conventional cleaning brush roll 107. It may also include a pair of detoning rolls (not shown) for removing the residual toner from the brush. Other cleaning systems, such as fur brush or blade, are also suitable. Subsequent to such cleaning, a discharge lamp 109 may be used to flood that portion of the photoconductive surface of belt 10 with light in order to dissipate any residual electrostatic charge remaining on such portion, prior to the recharging of such portion for each successive imaging cycle.

With particular reference now to the second tri-level imager module 309, the condition of its photoreceptor belt 10 (after exposure under control of the ESS 13) is such that it contains a second tri-level image that includes custom CAD image areas, custom DAD image areas, and background areas.

As illustrated, as the belt photoreceptor 10 of the second imager module 309 moves past its first development station 2C, including a development unit 180 containing Cyan (C) marking material in accordance with the present invention, the custom CAD image areas of its tri-level latent image are developed as a first image separation thereon, with the cyan C marking material. The cyan is laid laying down in regions of the desired final pictorial image that shall be in cyan, green or blue. The CAD image areas are described as custom because they deliberate include regions of the desired final pictorial image that shall be in cyan, green or blue. The development unit 180 can be a Non Interactive Development (NID) device or a magnetic brush development device since the CAD image areas are the first image being developed. Next, the tri-level image (now including the cyan developed image) is moved past the second development station 2D including a second development unit 184 containing Magenta M marking material. Development unit 184 thus develops the custom DAD image areas with magenta by laying magenta down only in regions of the desired final pictorial image that shall be red or pure magenta.

The second development unit 184 thus deposits the magenta marking material (M) onto the DAD image areas of the tri-level image of this module to form a second separation image, and thus a second composite color separation image (C, M) on the belt 10.

Following such development, the second composite color separation image (C, M) is moved to the pretransfer charging station 2E. Because the composite image developed on the photoreceptor consists of both positive and negative marking material, a typically positive pretransfer corona discharge member 98 disposed at the pretransfer charging station is provided for conditioning the marking material or toner for effective transfer to a substrate at the transfer station using positive corona discharge. The pretransfer corona discharge member 198 is also preferably an AC corona device biased with a DC voltage.

Subsequently, at the transfer station 2F, the second composite color separation image (C, M) is transferred, in registration with the previously transferred first composite image (Y, K1), onto the Intermediate Transfer Belt (ITB) 102 using a transfer corona device 104). As shown, transfer station 2F includes a corona generating device 104 which sprays ions of a suitable polarity onto the backside of belt 102. This attracts the second composite color separation image (C, M) from the photoreceptor belt 10 onto the ITB 102. After transfer, the ITB continues to move, in the direction of arrow 106 towards the third tri-level module 311 of the present invention.

After the second composite image (C, M) has been transferred to the ITB 102 from a portion of the photoconductive surface of belt 10 of module 309, residual toner or marking particles left on such portion of the surface of the belt 10 are removed at cleaning station 2G. As shown, cleaning station 2G is similar to cleaning station 1G and thus includes, for example, a conventional cleaning brush roll 107. It may also include a pair of detoning rolls (not shown) for removing the residual toner from the brush. Other cleaning systems, such as fur brush or blade, are also suitable. Subsequent to such cleaning, a discharge lamp 109 may be used to flood that portion of the photoconductive surface of belt 10 with light in order to dissipate any residual electrostatic charge remaining on such portion, prior to the recharging of such portion for each successive imaging cycle.

With particular reference now to the third tri-level imager module 311, the condition of its photoreceptor belt 10 (after exposure under control of the ESS 13) is also such that it contains a third tri-level image that has charged image areas for CAD, discharged image areas for DAD, and background areas.

As illustrated, the belt photoreceptor 10 of the third imager module 311 moves past its first development station 3C which includes a development unit 280 also containing Magenta M marking material in accordance with the present invention. Development unit 280 thus develops the CAD image areas of the third tri-level image by laying down magenta M only in regions of the desired final pictorial image that shall be blue. The CAD image areas as developed form a first image separation image on belt 10 of the third module 311. Next, the tri-level image (now including the magenta developed image) is moved past the second development station 3D including a second development unit 284 containing a first optional color X1. Development unit 284 thus develops the DAD image a areas of the third tri-level image with such optional color marking material X1 by laying X1 down only in regions of the desired final pictorial image that shall be, for example, of a second black K2, or of some other selected such color X2.

As pointed out above optional colors X1, X2 can include a second but different density black (K2), or any bright colors such as red (R), green (G) or blue (B), in order to increase the output color gamut, or it can be a special custom color for logos and the like. Thus the second optional color X2 in the development unit 284 can be a second black (K2) having at least a characteristic difference, such as density difference, distinguishing it from the first black color K1.

The second development unit 284 thus deposits the optional color marking material (X1) onto the DAD image areas of the third tri-level image of this third module to form a second separation image thereon, and thus a third composite color separation image (M, X1) on the belt 10.

Following such development, the third composite image (M, X1) is moved to the pretransfer charging station 3E. Because the composite image developed on the photoreceptor consists of both positive and negative marking material, a typically positive pretransfer corona discharge member 98 disposed at the pretransfer charging station is provided for conditioning the marking material or toner for effective transfer to a substrate at the transfer station using positive corona discharge. The pretransfer corona discharge member 98 is also preferably an AC corona device biased with a DC voltage.

Subsequently, at the transfer station 3F, the third composite color separation image (M, X1) is transferred, in registration with the previously transferred first and second composite images (Y, K1) and (C, M), onto the Intermediate Transfer Belt (ITB) 102 using a transfer corona device 104). As shown, transfer station 3F includes a corona generating device 104 which sprays ions of a suitable polarity onto the backside of belt 102. This attracts the third composite color separation image (M, X1) from the photoreceptor belt 10 onto the ITB 102. After transfer, the ITB 102, with the desired final pictorial image thereon continues to move, in the direction of arrow 106 towards a substrate transfer station 130 where the desired final pictorial image is transferred onto a sheet for fusing.

After the third composite color separation image (M, X1) has been transferred to the ITB 102 from a portion of the photoconductive surface of belt 10 of module 311, residual toner or marking particles left on such portion of the surface of the belt 10 are removed at cleaning station 3G. As shown, cleaning station 3G is similar to cleaning station 1G and thus includes, for example, a conventional cleaning brush roll 107. It may also include a pair of detoning rolls (not shown) for removing the residual toner from the brush. Other cleaning systems, such as fur brush or blade, are also suitable. Subsequent to such cleaning, a discharge lamp 109 may be used to flood that portion of the photoconductive surface of belt 10 with light in order to dissipate any residual electrostatic charge remaining on such portion, prior to the recharging of such portion for each successive imaging cycle.

At the substrate transfer station 130, the final pictorial quality image is transferred from the ITB 102 onto a final substrate 131, such as plain or coated paper. A transfer corona discharge device 132 preferably is provided for facilitating such transfer. Transfer can also be accomplished with a biased transfer roll in place of the corona generating device.

The substrate 131 with the transferred image thereon is then moved to a fuser assembly, indicated generally by the reference numeral 134, which permanently affixes the transferred image to substrate 131. Preferably, fuser assembly 134 comprises a heated fuser roller 136 and a pressure roller 138. Substrate 131 passes between fuser roller 136 and pressure roller 138 with the toner powder images contacting fuser roller 136. In this manner, the toner powder image is permanently affixed to substrate 131. After fusing, a chute, (not shown), guides the advancing substrate 131 to a catch tray, also (not shown), for subsequent removal from the machine or apparatus 300 by the operator.

Advantageously, in the tandem tri-level xerographic machine of the present invention there is no requirement to expose through a previously developed image, and all composite color separations transfer with io efficiencies comparable to conventional transfer efficiencies. The print throughput rate is same as the process speed of individual tri-level modules 308, 309, and 311. Additionally, the modular architecture of the machine 300 eliminates any need for continuous, very long (12 foot) photoconductor belts which are currently very difficult to manufacture (low yields/expensive). When compared to any other tandem single pass color imaging system, it also requires one less module (it uses three instead of four modules), and one less ROS assembly. Consequently, only three composite color separations need to be registered (instead of four or five conventionally) in order to produce the desired final pictorial color image. Each such registration involves adding already perfectly registered, tri-level two color separations (K1, Y), (C, M) and (M, X1).

Thus to recap, as will be understood by those skilled in the art, it is well within the programmed capability of the controller or control subsystem ESS 13 to read, recognize and work with image data information defining which areas of the desired final pictorial image being exposed and developed as separation images shall be black, yellow, green, red, and blue, as well as those to be printed in pure cyan or magenta.

In the tandem xerographic apparatus 300, the first development station 1C of the first module 308 includes a development unit 80 containing black marking material K1, while its second development station 1D includes a development unit 84 containing yellow marking material Y, both developments units being controlled by controller 13.

The first development unit 80 of the first tri-level xerographic module 308 develops its CAD image areas by laying down black (K1) marking material in areas of the final pictorial image that will be black, and that will be part of a first composite color separation image (K1, Y) being formed thereby. The first tri-level xerographic module 308 then develops the DAD image areas of its tri-level image at the second development unit 84 by laying down yellow marking material Y in regions of the desired final composite image that shall be in yellow, as well as in green or red.

Based on and using the same controls, the first development unit 180 of the second module 309 develops its CAD image areas by laying down Cyan in regions of the desired final pictorial image that shall be in cyan, green or blue. The second development unit 184 thereof contains Magenta M, and develops the DAD image areas with magenta by laying it down only in regions of the desired final composite image that shall be red or pure magenta.

Finally, the first development unit 280 of the third and last module 311 also contains magenta, and develops its CAD tri-level latent image by laying down magenta only in regions of the desired final composite image that shall be blue. Its second development unit 284 thereof contains an optional color X1, and develops the DAD image with such optional color by laying it down only in regions of the desired final composite image that shall be of a second black or of some other selected such color.

The particular advantage of the tandem xerographic apparatus 300 is that the cyan components of green and blue, and the magenta component of red are printed together in perfect registration by the second tri-level xerographic module 309. Furthermore, because these are the darker components of red, green and blue, and because the eye is less sensitive to color shifts caused by registrations errors in the placement of yellow, this embodiment is more tolerant of any registration errors between the three superimposed color separations.

As can be seen, there has been provided apparatus and method for creating highly registered quality pictorial color images. Apparatus for practicing the method include a charging device for uniformly charging photoconductive member of a first tri-level xerographic module to a predetermined voltage level; using a controller and a ROS device for creating tri-level latent electrostatic images comprising custom CAD image areas and custom DAD image areas having different voltage levels respectively; two development units for developing the custom CAD image areas and the custom DAD image areas with yellow (Y) and black (K1) marking materials respectively to form a first composite color separation image of a desired final pictorial image; transferring the first composite color separation image onto an intermediate transfer member; similarly forming and developing a second composite color image using cyan C and magenta M marking materials on a second tri-level xerographic module; transferring the second composite color separation image, in registration with the first composite color separation image, onto the intermediate transfer member; similarly forming and developing a third composite color image using magenta M and a first optional color (X1) marking materials on a third tri-level xerographic module; transferring the third composite color separation image in registration with the first and second composite color separation images, onto the intermediate transfer member to form a desired final pictorial image; and transferring the desired final pictorial image onto a substrate for fusing onto the substrate at a fusing station.

What is claimed is:

1. A method of creating highly registered quality pictorial color images using tri-level xerographic modules, the method comprising the steps of:

(a) uniformly charging a photoconductive member of a first tri-level xerographic module to a predetermined voltage level;

(b) creating a first tri-level latent electrostatic image including custom CAD image areas and custom DAD image areas, having different voltage levels respectively;

(c) developing the CAD image areas and the custom DAD image areas of the first tri-level image with a first color and a second color marking materials respectively to form a first composite color separation image of a desired final pictorial image;

(d) transferring the first composite color separation image onto an intermediate transfer member;

(e) similarly creating and developing, on a second tri-level xerographic module, a second tri-level image using a third color and a fourth color, marking materials respectively, to form a second composite color separation image;

(f) transferring the second composite color separation image, in registration with the first composite color separation image, onto the intermediate transfer member;

(g) similarly creating and developing, on a third tri-level xerographic module, a third tri-level image using a fifth color and a sixth color, marking materials respectively, to form a third composite color separation image;

wherein the pair of first and second, third and fourth, and fifth and sixth, color marking materials are selected so that one such pair is cyan (C) and magenta (M) for improving registration of the desired final pictorial image; and (h) transferring the third composite color separation image in registration with the first and second composite color separation images, onto the intermediate transfer member to form a desired final pictorial image; and a substrate transfer station for transferring the desired final pictorial image onto a substrate for fusing.

2. The method of claim 1, wherein said step of developing the CAD image areas and the custom DAD image areas of the first tri-level image with a first color and a second color marking materials respectively comprises developing the custom CAD image areas and the custom DAD image areas with black (K1) and yellow (Y) marking materials respectively.

3. The method of claim 2, wherein said step of developing the first tri-level image includes laying down magenta M marking material in custom DAD image areas comprising regions of the desired final pictorial image that shall be red.

4. The method of claim 2, wherein said step of developing the first tri-level image includes laying down magenta M marking material in custom DAD image areas comprising regions of the desired final pictorial image that shall be pure magenta.

5. The method of claim 1, wherein said step of similarly creating and developing, on a second tri-level xerographic module, a second tri-level image using a third color and a fourth color, marking materials respectively, comprises developing the custom CAD image areas and custom DAD image areas of the second tri-level image with cyan (C) and magenta (M) marking materials respectively, so as to improve registration of the desired final pictorial image.

6. The method of claim 5, wherein said step of creating and developing the second tri-level image includes laying down magenta M only in the custom CAD image areas comprising regions of the desired final pictorial image that shall be blue.

7. The method of claim 5, wherein said step of creating and developing the second tri-level image includes laying down optional color X1 marking material in custom DAD image areas comprising regions of the desired final pictorial image that shall be a second black K2.

8. The method of claim 5, wherein said step of creating and developing the second tri-level image includes laying down optional color X1 marking material in custom DAD image areas comprising regions of the desired final pictorial image that shall be a non-black optional color.

9. The method of claim 8, wherein the non-black optional color comprises any of a bright color among the bright colors red, green and blue, for increasing an output color gamut of the desired final pictorial image.

10. The method of claim 1, wherein said step of similarly creating and developing, on a third tri-level xerographic module, a third tri-level image using a fifth color and a sixth color, marking materials respectively, comprises developing the custom CAD image areas and custom DAD image areas of the third tri-level image with magenta (M) and an optional color (X1) marking materials respectively.

11. A tandem xerographic apparatus for creating highly registered quality pictorial color images in a single pass, the tandem xerographic apparatus comprising:

(a) a first tri-level xerographic module including:

(i) a charging device for uniformly charging a photoconductive member thereof to a predetermined voltage level;

(ii) a controller and a ROS device for creating a first tri-level latent image including custom CAD image areas and custom DAD image areas having different voltage levels respectively;

(iii) first and second development units for developing said custom CAD image areas and said custom DAD image areas of said first tri-level xerographic module with a first color and a second color, marking materials respectively, to form a first composite color separation of a desired final pictorial image; and (iv) a transfer station for transferring said first composite color separation image onto an intermediate transfer member;

(b) a second tri-level xerographic module including:

(i) a charging device for uniformly charging a photoconductive member thereof to a predetermined voltage level;

(ii) a controller and a ROS device for creating a second tri-level latent image including custom CAD image areas and custom DAD image areas having different voltage levels respectively;

(iii) first and second development units for developing said custom CAD image areas and said custom DAD image areas of said second tri-level xerographic module with third color and a fourth color, marking materials respectively, to form a second composite color separation image of the desired final pictorial image; and (iv) a transfer station for transferring said second composite color separation image, in registration with said first composite color separation image, onto the intermediate transfer member;

(c) a third tri-level xerographic module including:

(i) a charging device for uniformly charging a photoconductive member thereof to a predetermined voltage level;

(ii) a controller and a ROS device for creating a third tri-level latent image including custom CAD image areas and custom DAD image areas having different voltage levels respectively;

(iii) first and second development units for developing said custom CAD image areas and said custom DAD image areas of said third trilevel xerographic module with a fifth color and a sixth color, marking materials respectively, to form a third composite color separation image of the desired final pictorial image; wherein pairings of first and second, third and fourth, and fifth and sixth, color marking materials are selected so that one such pairing is cyan (C) and magenta (M) so as to improve registration of the desired final pictorial image; and (iv) a transfer station for transferring said third composite color separation image, in registration with said first composite color separation image, onto the intermediate transfer member; and (d) a substrate transfer station for transferring the desired final pictorial image onto a substrate for fusing at a fusing station to form a finished copy.

12. The tandem xerographic apparatus of claim 11, wherein said first color and said second color, marking materials comprise yellow Y and black K1 marking materials.

13. The tandem xerographic apparatus of claim 11, wherein said third color and said fourth color, marking materials comprise cyan C and magenta M, marking materials.

14. The tandem xerographic apparatus of claim 11, wherein said fifth color and said sixth color, marking materials comprise magenta M and an optional color X1, marking materials.

15. The tandem xerographic apparatus of claim 11, wherein each said ROS device for creating the first tri-level image, the second tri-level image, and the third tri-level image, comprises a single exposure device operating at two different levels.

* * * * *